United States Patent [19]

Loos

[11] Patent Number: 4,921,285

[45] Date of Patent: May 1, 1990

[54] CONNECTING ROD GEARING

[75] Inventor: Horst Loos, Freudenberg-Lindenberg, Fed. Rep. of Germany

[73] Assignee: Siegenia-Frank KG, Siegen, Fed. Rep. of Germany

[21] Appl. No.: 198,982

[22] Filed: May 26, 1988

[30] Foreign Application Priority Data

May 29, 1987 [DE] Fed. Rep. of Germany ..... 3718173

[51] Int. Cl.[5] ..... E05C 9/12

[52] U.S. Cl. ..... 292/39; 292/142

[58] Field of Search ..... 49/394, 395; 292/39, 292/142, 160, 172, 22, 32, 33, 35, 337, 40, 51, 41

[56] References Cited

U.S. PATENT DOCUMENTS

| | | | |
|---|---|---|---|
| 1,334,314 | 3/1920 | Parsons | 292/39 |
| 2,166,535 | 7/1939 | Sarenholm et al. | 292/39 |
| 3,086,383 | 4/1963 | Scott | 292/39 |
| 3,110,512 | 11/1963 | Scalf et al. | 292/39 |
| 4,616,864 | 10/1986 | Douglas | 292/39 X |
| 4,754,624 | 7/1988 | Fleming et al. | 292/302 X |

FOREIGN PATENT DOCUMENTS

| | | | |
|---|---|---|---|
| 567696 | 5/1958 | Belgium | 292/39 |
| 0002248 | 6/1979 | European Pat. Off. . | |
| 0128372 | 12/1984 | European Pat. Off. . | |
| 604687 | 10/1934 | Fed. Rep. of Germany . | |
| 677389 | 6/1939 | Fed. Rep. of Germany . | |
| 1940854 | 6/1966 | Fed. Rep. of Germany . | |
| 1950153 | 10/1969 | Fed. Rep. of Germany | 292/39 |
| 2557303 | 8/1976 | Fed. Rep. of Germany . | |
| 3300976 | 7/1984 | Fed. Rep. of Germany | 292/39 |
| 560048 | 6/1923 | France | 292/39 |
| 840050 | 1/1936 | France | 292/39 |
| 477416 | 12/1937 | United Kingdom | 292/39 |

*Primary Examiner*—Eric K. Nicholson

*Attorney, Agent, or Firm*—Norman S. Blodgett; Gerry A. Blodgett

[57] ABSTRACT

A connecting rod gearing for windows, doors, etc. having two oppositely shiftable connecting rods under a cover rail. The rotational plane for the toothed rim of a pinion and the plane of motion of the engagement toothings which mesh therewith on two thrust links lie in the cross-sectional area of the housing usually occupied by the cover rail so that the crown (addendum) circle diameter of the pinion can correspond to the complete cross-sectional width of the cover rail. This large pinion diameter results in correspondingly large adjustment differences for the two oppositely shiftable thrust links for a given angle of rotation of the pinion.

14 Claims, 2 Drawing Sheets

III
II
14
1
12
12a
12b
13
13a
13b
13c
15
16
17
18
19
20
21
22
22a
22b
22c
22d
22e
23
23a
23b
23c
23d
23e
24
25
25a
25b
25c
25d
25e
25f
26
27
28
29
30
31
31a
32
32a
33a
33b
34
35

CONNECTING ROD GEARING

BACKGROUND OF THE INVENTION

This invention relates to a connecting rod gearing c for the installation into a stepped profiled slot in a window or frame, etc. Such a window or frame has two connecting rods, oppositely shiftable with respect to one another, under a cover rail. In each case, two thrust links, equipped with engagement teeth, are guided in a housing and held in engagement from opposite sides with a pinion. The housing consists of the flat cover rail of the connecting rod mounting and of a cross-sectionally U-shaped channel resting on the back of the rail. The channel has a smaller width than that of the cover rail. The rotational plane of the pinion lies parallel to the plane of the cover rail of the housing.

Connecting rod gearings for windows, doors, etc. with two oppositely shiftable connecting rods have long been known, as can be learned, for example, from the German patent Nos. 604,687 and 677,389. The pinion meshing with the engagement teeth of the thrust links or connecting rods can be used directly as the driving link of the connecting rod gearing when the pinion is brought into working connection with a control handle (for example, a control grip (German patent No. 604,687). On the other hand, the pinion meshing with the engagement teeth of the thrust links or connecting rods may also be installed so that merely a thrust-direction reversal gearing is formed, by means of which the thrust motion derived from one of the two connecting rods is converted into a motion opposite thereto at the other connecting rod (German patent No. 677,389).

Prior connecting rod gearings for windows, doors, etc. (German references DE-GM1940854 and DE-AS2557303), not only display the initially mentioned features, but also have a configuration which permits their installation in profiled slots at the folding faces of the wings or frames of windows, doors, etc. Such slots have an inner slot step, with a width of 12 mm. and a depth of 9 mm., as well as an outer slot step, with a width of 16 mm. and a depth of, at most, 2.5 mm.

German references DE-GM1940854 and DE-AS2557303 show how such connecting rod gearings, for the transmission of any adjusting forces which occur, can be designed to be sufficiently stable and therefore functionally reliable when they are used as pure thrust-direction reversal gearing. In these cases, however, the effective diameter of the pinion meshing with the thrust links or connecting rods has no direct effect on the regulating distance through which the connecting rods have to pass. This is because these distances are determined from an additional actuating gearing which is installed at another place and acts upon one of the connecting rods. The angle of rotation of the pinions, which act here solely and specifically as reversal links, is practically unlimited on such thrust-direction reversal gearings.

However, there are times when the species-appropriate type of pinion is simultaneously used on connecting rod gearings for windows, doors, etc. as a driving link for actuation of a connecting rod mounting. It is connected with an operating handle, for example, a control grip. In such cases, the angle of rotation of the pinion is limited as a rule to 90 degrees, or maximally 180 degrees, for technical reasons having to do with service.

Since the maximal diameter of the pinions provided in the installation design of prior known connecting rod gearings (DE-GM1940854 and DE-AS2557303) cannot be greater than the 12 mm. width of the lower slot step of the profiled slot provided in the wing or frame, in each case only small regulating distances can be imparted to the connecting rods which are moved oppositely to one another by means of the pinion. Specifically, on a 90 degree rotation of the pinion, the regulating distance for each one of the connecting rods is approximately 7 mm., while on a 180 degree rotation of the pinion, it can attain 14 mm. at most.

Nowadays for practical application and especially for reliability, regulating distances for connecting rods and mountings for windows, doors, etc. are required to amount to, at a minimum, 10 mm. and should preferably reach 20 mm. Given the installation dimensions of specific types of connecting rod gearings, these regulating distances would be attainable only by using angles of rotation for the pinions which would be either 130 degrees or 260 degrees. However, providing connecting rod gearings with control grips acting as service handles which employ angles of rotation other than 90 degrees of 180 degrees is highly unusual and not adaptable for practical use.

It is, therefore, a primary aim of the invention to include a species-appropriate connecting rod gearing so that its driving links can be manufactured despite a limited cross-sectional dimension of the profiled slots which serve for the take-up of the connecting rod mountings. The object is to allow fabrication by customary methods in the fittings industry and to insure a strong, durable, functionally reliable fitting.

A further object of the invention is to create a connecting rod gearing of the above-mentioned construction which makes use of the oppositely directed coupling of the two thrust links or connecting rods by means of one pinion only and which only needs to pass through an angle of rotation of 90 degrees for a regulating distance of at least 10 mm. and at most, an angle of rotation of 180 degrees for a regulating distance of at least 20 mm.

SUMMARY OF THE INVENTION

The invention involves the provision of a gap in the cover rail of the housing in the neighborhood of the range of motion of the pinion and of the connecting rods. The gap is bridged by the U-shaped, profiled channel under the cover rail plane. The installation plane of both the pinion teeth and the thrust link teeth are located in the cross-section area of the cover rail gap above the channel. The crown circle, or addendum circle, diameter of the pinion teeth corresponds at least approximately to the cover rail width. This cover rail gap is covered on the outside by means of a protective cap. This construction of a connecting rod gearing, according to the invention, achieves the advantage that the 16 mm. width of the profiled slot step (which is provided in the wing or frame cross-section for accommodation of the connecting rod mounting) can be fully used to accommodate the mutually meshing engagement teeth of the pinion and thrust links. This assures that the required regulating distances can be securely obtained using angles of rotation of the pinion of 90 degrees or 180 degrees.

Nevertheless, no additional openings are needed in the window or frame profile for installation of connecting rod gearing in the case where it is possible to accommodate the operating handle for the connecting rod gearing directly adjacent to the folding face of the wing or of the frame. This is especially possible in the case of windows and doors, etc. where two wings are installed into one and the same frame in a side-by-side manner so that they can directly interact at the frame without the interposition of a fixed center post (cover rail windows and doors).

In such cases, a connecting rod gearing, according to the invention, can be installed at the fold face of the underfolding wing. It can be actuated by means of the operating handle after the overfolded wing has first been opened.

A connecting rod gearing with the features of the invention is also conceivably useful in the case of connecting rod mountings for windows, doors, etc. which are used only as thrust direction reversal mechanisms. In this configuration a connecting rod gearing of customary type is employed for the actual working of the connecting rod mounting and is located at a remote site from the mounting.

A further aspect of the invention is that the mutually facing end sections of the cover rail are undergripped by the legs of the mutually averted ends of the U-shaped channel and are in firm connection with this channel (for example, by riveting and/or welding).

A further aspect of the invention is the provision of a protection cap, preferably fabricated of thin-walled material. This can also be riveted and/or welded to the legs of the U-shaped channel and/or the mutually facing ends of the cover rail in such a manner that it projects only a small degree beyond the plane of the external broadside of the cover rail.

In another aspect of the invention, the pinion is provided with an engagement dog or engagement lug aligned with its axis of rotation and which lies exposed in the area of an opening of the protection cap, whereby it can be coupled with an operating handle. When the connecting rod gearing is to be directly actuated by means of an operating handle, a specific aspect of the invention is the provision of a pinion with four teeth arranged equally distributed around the circumference. The pinion is so installed that in the two possible end shifting positions of the two thrust links, the teeth of the pinion occupy an angular position of 45 degrees relative to the shifting direction of the thrust links. This produces a particularly favorable self-locking phenomenon for certain uses of the connecting rod gearing, which cannot be overcome by a thrust force on the connecting rods, but only by applicational of a torsional force at the pinion.

In a further aspect of the invention, the bearing shaft of the pinion is enclosed within the U-shaped channel and is axially and radially supported by means of a setoff neck in a bearing opening at the bottom of the U-shaped channel.

A further aspect of the invention is that the thrust links project into the U-shaped channel by means of recessed guiding sections and by them are supported both against the front faces and against the inside surfaces of the legs of the channel cross-section. For this purpose, the thrust links have an angular cross-section and are provided with a stiffening or guiding ledge at the inside of the angle, the width of which is adapted to the thickness of the channel legs. The angular leg of each thrust link projects laterally from the U-shaped channel and is provided at its top with engagement teeth In each case, it is overlapped in the area of the gaps of these teeth by the teeth at the rim of the pinion.

Furthermore, the bearing shaft of the pinion may also be provided with a neck-like extension which penetrates through the opening of the protection cap. In this case it is possible to mold at least one axially parallel engaging slot into the jacket of the neck-like extension of the bearing shaft, with which it can be brought into engagement with an engaging ledge located at the inside circumference of a clutch hub on an operating handle. This can be slipped onto the neck-like extension.

The bearing shaft of the pinion may be provided with a paraxial channel opening out, for example, at the front face of the neck-like extension. This preferably has a polygonal cross-section into which a correspondingly profiled engagement lug of the operating handle can optionally be inserted. The channel may also receive a self-tapping fastening screw for the operating handle.

It is preferred that the neck-like extension of the bearing shaft be adapted to the root circle diameter of the pinion tooth rim.

BRIEF DESCRIPTION OF THE DRAWINGS

The character of the invention, however, may be best understood by reference to one of its structural forms, as illustrated by the accompanying drawings , in which.

DESCRIPTION OF PREFERRED EMBODIMENT

Figures 1, 2:
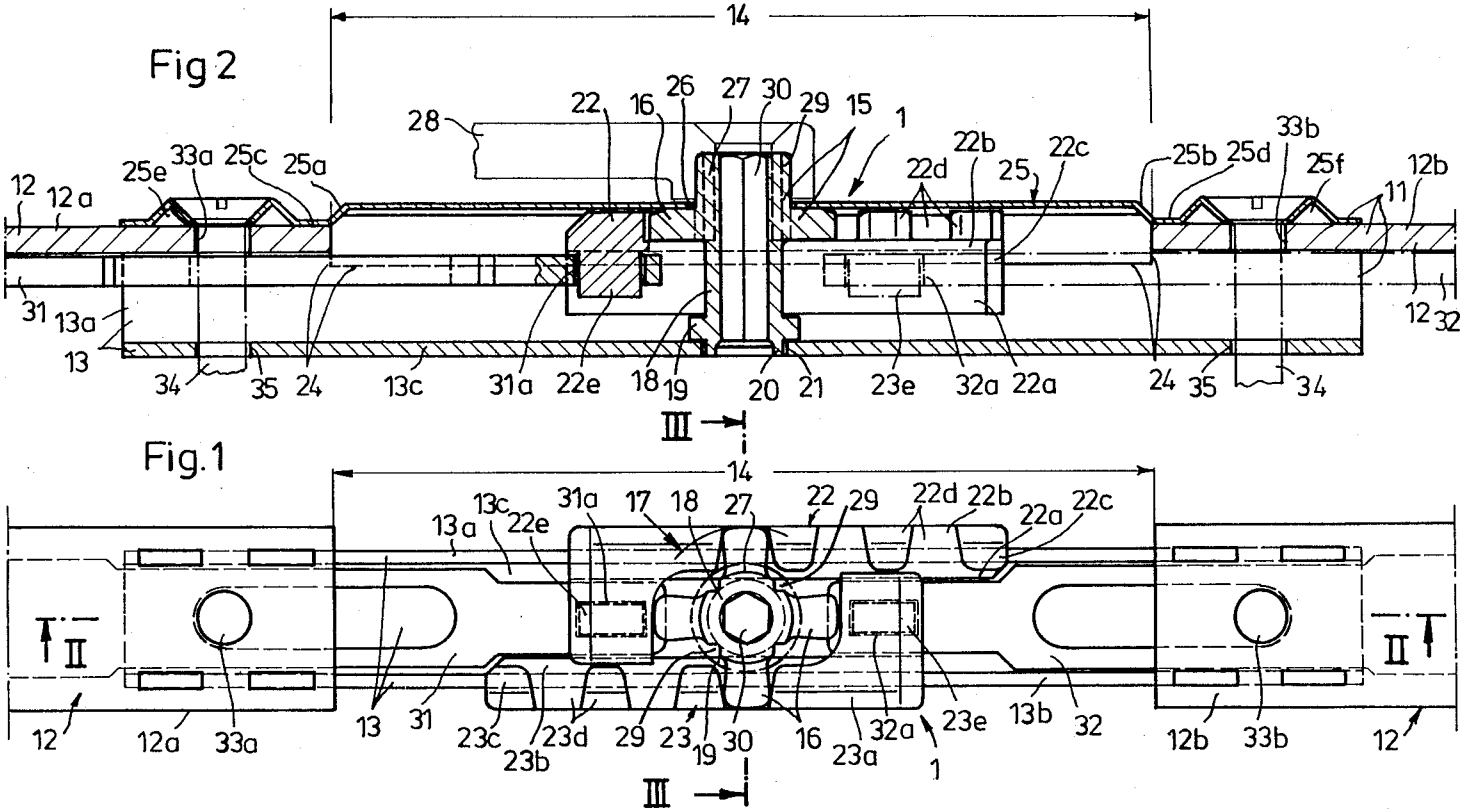
FIG. 1 shows a top view of the connecting rod gearing of a connecting rod mounting according to the present invention before the application of the protection cap which covers the gear linkages.
FIG. 2 is a longitudinal cross-section along the line II—II in FIG. 1 through the connecting rod gearing showing the protection cap overspanning the gear link.

The connecting rod gearing 1 shown in the drawings can be used for all connecting rod mountings of windows, doors, etc. which are installed into a stepped profile slot 2 at the fold face 3 of a wing 4. The gearing can also be used with a stationary frame as may be seen, for example in FIG. 3. Each profiled slot 2 is customarily provided with two different slot steps, an inner slot step 5 and an outer slot step 6 having variable width and depth. In this case, the inner slot step 5 has a width 7 of about 12 mm. and a depth 8 of about 9 mm. The outer slot step 6 has a width 9 of about 16 mm. and a depth 10 of about 2.5 mm. Both slot steps 5 and 6 are symmetrically arranged about a common longitudinal median plane. The width 9 of the outer slot step 6 extends beyond the width 7 of the inner slot step 5 equally on both sides; in each case by 2 mm.

Figure 3:
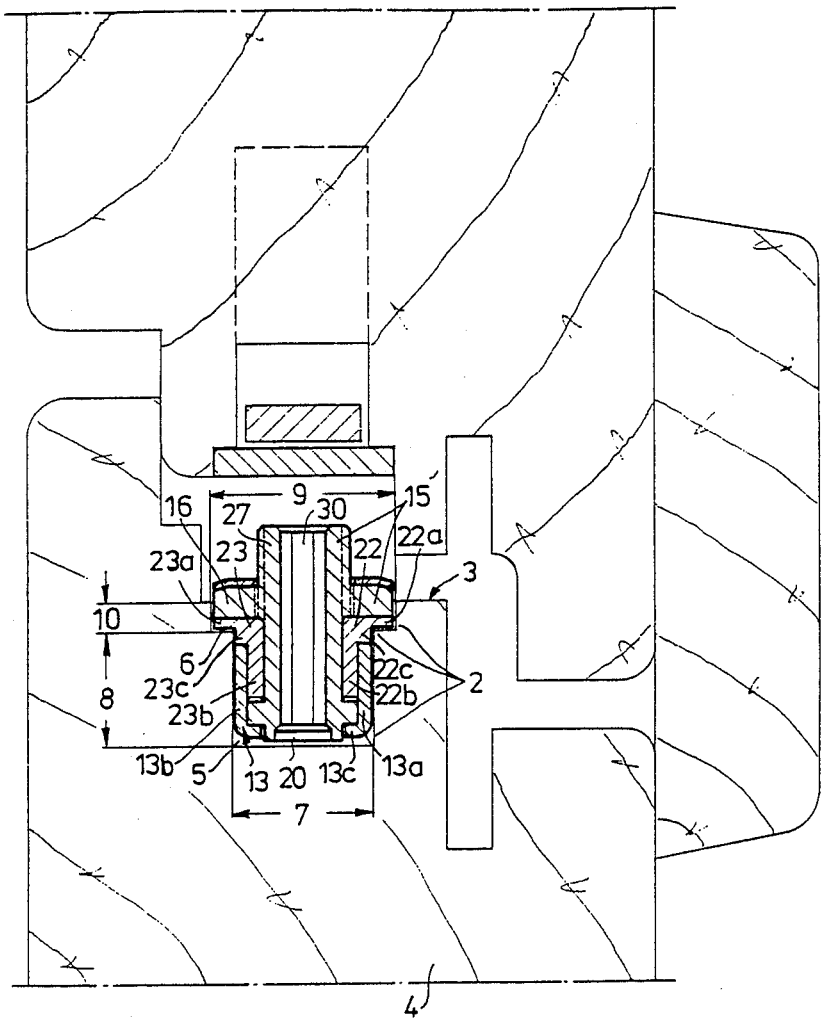
FIG. 3 is a cross-section of the connecting rod gearing along the line III—III in FIG. 1 in the neighborhood of the installation position of the pinion, in which also can be seen the relationship of the connecting rod gearing to a winged profile of a double sash window.

A connecting rod gearing 1 has a housing 11 whose cross-sectional shape corresponds to the cross-sectional shape of the stepped profiled slot 2 on the fold face 3 of the wing 4 (or the frame as may be seen particularly well in FIG. 3). This housing 11 is formed by a cover rail 12 of rectangular cross-section and a channel 13 of U-shaped cross-section at the back of the cover rail 12. The cross-sectional dimensions of the rectangular cover rail 12 corresponds to the width 9 and depth 10 of the outer slot step 6 of the profiled slot 2. The outer cross-sectional dimensions of the channel 13 correspond to the width 7 and the depth 8 of the inner slot step 5.

Both the cover rail 12 and channel 13 are fabricated of metal. The cover rail 12 consists preferably of flat rolled steel, for example, a rolled steel strip, while the channel 13 is a steel profile of U-shaped cross-section preferably fabricated from steel sheet as a punched or bent part.

The channel 13 comprises legs 13*a* and 13*b* and a bottom 13*c*. To form the housing 11, two cover rail sections 12*a* and 12*b* are each connected to both legs 13*a* and 13*b* of the channel 13, for example by rivets, in such a manner that the plane of their broadsides runs parallel to the plane of the bottom 13*c* of the channel 13.

The two cover rail sections 12*a* and 12*b* are joined with the legs 13*a* and 13*b* of the channel 13 in such a manner that the mutually facing ends of the cover rail sections are held at a distance 14 from each other. This distance is bridged rigidly through the channel 13 of the U-shaped profile. Thus, the cover rail 12 is interrupted across its entire width along the distance 14 in the neighborhood of the housing 11 of the connecting rod gearing 1.

As may be seen in FIG. 1 of the drawings, it may prove advantageous to provide webs in the end regions of the legs 13*a* and 13*b* of the channel 13 which engage positively in corresponding slits of the cover rail sections 12*a* and 12*b* to facilitate riveting or wedging.

A pinion 15 is pivotally attached in the housing 11 at the half-way point of the channel having the U-shaped cross-section profile and at the half-way point of the gap in the cover rail 12 as determined by the distance 14. The toothed rim 16 of the pinion 15, along with the pinion teeth, thus lies within the cross-sectional region of the housing 11 that has been kept free within the gap determined by the distance 14 in the cross-section of the cover rail 12 (that is, by the two cover rail sections 12*a* and 12*b*). The crown circle or addendum circle diameter 17 of the toothed rim 16 of the pinion 15 can therefore be constructed to correspond in measure to the cross-sectional width of the U-rail 12 (or the sections 12*a* and 12*b*) which is at least approximately adapted to the width 9 of the outer slot step 6 in the profiled slot 1 of the wing 4, or the frame.

A bearing shaft 18 for the pinion 15 projects into the inside space of the channel 13 between its two legs 12*a* and 13*b*. It is provided with a collar 19 above its free end which has a diameter which corresponds to the inside measure between the two legs 13*a* and 13*b* of the channel 13. By means of this collar 19, the bearing shaft 18 is braced axially against the bottom 13*c* of the channel 13. A recessed neck 20 of the bearing shaft 18 engages, below the collar 19, in a bearing bore 21 on the bottom 13*c* of the channel 13 and is centered thereby. Above the collar 19, the bearing shaft 19 of the pinion 15 has a diameter that corresponds to the diameter of the neck 20 so that a gap, or free space, remains in each case at the sites between the peripheral area or the jacket of the bearing shaft 18 and the inner faces of the two legs 13*a* and 13*b* of the channel 13.

The length of the bearing shaft 18 between the back of the toothed rim 16 of the pinion 15 and the front face of the collar 19 which is braced at the bottom 13*c* of the channel 13 is such that there is also a free gap or space between the back of the toothed rim 16 and the end edges of the two legs 13*a* and 13*b* of the channel 13. This is provided at least over the portion of the range within the cross-sectional zone which generally corresponds to the installation cross-section of the cover rail 12 or the cover rail sections 12*a* and 12*b*.

It is preferable that each of the thrust links 22 and 23 is provided at its internal angle with a stiffening and/or guiding ledge 22*c* or 23*c* the width of which is adapted to the material thickness of the legs 13*a* and 13*b* of the channel 13. These stiffening or guiding ledges 22*c*, 23*c* engage with release mechanisms 24 on the channel legs 13*a* and 13*b*. These release mechanisms 24 are located at the end edges of the two channel legs 13*a* and 13*b* and in each case extend over a length which preferably corresponds to the distance 14 between the mutually facing ends of the cover rail sections 12*a* and 12*b*. This coincides, therefore, with the length of the gap provided in the cover rail 12.

On the outside of the profiled flange 22*b* or 23*b* of the thrust links 22 and 23, an engagement toothing 22*d* and 23*d* is formed which extends in longitudinal direction of each thrust link 22 or 23. This toothing projects into the region of the toothed rim 16 of the pinion 15. The length of the engagement toothings 22*d* and 23*d* of the thrust links is such that the toothings can interact with the pinion 15 across an angle of rotation of at least 90 degrees. However, the length of the engagement toothings should be preferably such that an interaction is assured with the pinion across an angle of rotation of 180 degrees. It can be seen particularly clearly in FIG. 1 of the drawings that the engagement toothings of the two thrust links are in engagement with the pinion 15 on diametrically opposite peripheral sides so that they are coupled with one another through the pinion 15 and thereby shifted in opposite directions. In FIG. 1, the inner or retracted shift position of the two thrust links is shown. In the outer or extended shift position of the thrust links, their mutually bent ends in each case reach to the limit of the distance 14 defined by the ends of the two cover rail sections 12*a* and 12*b*.

In the particular embodiment of the gearing 1 shown in the drawing, the pinion 15 has a turning position configured such that during the inner or retracted shifting position of the two thrust links 22 and 23, only one of the four teeth of its toothed rim 16, which are distributed equally and peripherally, engages each of the engagement toothings 22*d* and 23*d*. In this manner each of these teeth has a position which is approximately at right angles to the longitudinal direction of the engagement toothings 22*d* and 23*d*.

However, for many applications of this kind of connecting rod gearing 1, it may be advantageous to keep the pinion 15 in operative connection with the engagement toothings (at least in the outer or extended shifting position of the thrust links) so that at all times two of the four teeth of the toothed rim 16 cooperate with each of the engagement toothings 22*d* and 23*d*. This should be arranged so that the teeth have in each case an angular position of 45 degrees relative to the shifting direction of the thrust links 22 and 23. It is found that such an arrangement provides a self-locking effect which cannot be overcome by longitudinal forces acting on the thrust links 22 and 23, but is only overcome by a torsional force exerted upon the pinion 15 itself.

The gap in the cover rail 12 (or the cover rail sections 12*a* and 12*b*) of the housing 11 is externally covered by a thin-walled protection cap extending beyond the distance 14 which is preferably fabricated as a punched, stamped part of metal, especially sheet steel. This protection cap 25 covers the entire range of motion of the two thrust links 22 and 23 and also of the pinion 15 at the housing 11 at the front face. After installation of the thrust links 22 and 23 and the pinion 15 into the housing 11 of the connecting rod gearing 1, the protection cap 25 can be firmly connected to the bottom 13*c* of the channel 13, and also with the cover rail sections 12*a* and 12*b* of the housing 11 by means of riveting or welding.

In the neighborhood of the pinion 15, the protection cap 25 can be provided with a perforation 26 with which it engages a neck-like extension 27 of the pinion for additional support thereof (see FIGS. 2 and 3). In many cases it is sufficient that the neck-like extension 27 have an axial expansion which corresponds approximately to the material thickness of the protection cap 25. On the other hand, it may be preferable for the neck-like extension 27 to project by a certain measure beyond the front face of the protection cap 25. In this way it can serve as a clutch hub for an operating handle 28 which serves as control handle. In that case, the neck-like extension 27 can have axially parallel engaging slots 29 on its peripheral or jacket surface or peripheral flattenings can be provided, with which it can be brought into positive engagement with corresponding engagement ledges or faces located on the inside periphery of the clutch hub of the operating handle 28.

The pinion 15 and its bearing shaft 18 also have a profiled channel 30 at least at the front face of the neck-like extension 27 which is in axial alignment with the longitudinal axis and opens out with a polygonal (e.g. hexagonal) cross-section. This profiled channel 30 can thus be used as clutch engagement for a correspondingly profiled engagement lug on operating handle 28 or of a key if it is desired that these are to be only loosely insertable and only intermittently to be brought into operating connection with the pinion. If on the other hand it is desired to have an operating handle which is detachable but secured against undesired lifting for operation of the pinion 15 then the profiled channel 30 is also adapted to take up a self-tapping fastening screw the head of which then finds its thrust in a countersink at the front face of the clutch hub of the operating handle 28.

It should be noted that the overall depth of the toothed rim 16 of the pinion and of the engagement toothings which mesh with it on the thrust links 22 and 23 can be so dimensioned that it extends somewhat beyond the outer broadside of the cover rail 12 (or the cover rail sections 12*a* and 12*b*) which form a portion of the housing 11 for the connecting rod gearing 1. In this case it is preferable to provide the protection cap 25 with bends 25*a* and 25*b* so that it securely covers the installation space projecting beyond the outer broadside of the cover rail 12 across the distance 14.

On its respective underside facing towards the bottom 13*c* of the channel 13, each of the two thrust links 22 and 23 of the connecting rod gearing carry an engagement lug 22*e* or 23*e* through which it can be coupled with its respective connecting rod 31 or 32 by corresponding engaging recesses 31*a* or 32*a*. For this purpose the connecting rods 31 and 32 project out into the channel 13 of the housing 11.

As an alternative to the specific embodiment shown in the drawings, it is possible to fabricate the connecting rod gearing 1 as a structure separate from the cover rail sections 12*a* and 12*b* and from the connecting rods 31 and 32 which are longitudinally guided at their back, while simultaneously providing for the possibility of subsequent connection with the cover rail sections and the connecting rods. For this purpose it would be possible to afix only short cover pieces with corresponding flat rectangular cross-sectional profiles at the legs 13*a* and 13*b* instead of the cover rail sections 12*a* and 12*b*. The mutually facing transverse edges of these cover pieces would define the gap in the housing across the distance 14 These cover pieces can in fact also be readily formed as extension sections 25*c* and 25*d* of the protection cap 25. In this case the back of the cap 25 is connected upon one plane with the legs 13*a* and 13*b* of the channel which usually coincides with the plane of the outer broadside of the cover rail 12 or of the two cover rail sections 12*a* and 12*b* as can be seen also in FIG. 2. While, as shown in FIG. 2, the extension sections 25*c* and 25*d* of the protection cover 25 engage over their whole length at the outer broadside of the cover rail sections 12*a* and 12*b* , in the modified construction of the connecting rod gearing they project with those pieces which contain limited sink holes formed by relief-embossed circular bead 25*e* or 25*f* and are spaced from the end edges of the legs 13*a* and 13*b* by an amount which corresponds to the material thickness of the cross-sectionally flat rectangular cover rail 12 (or the sections 12*a* and 12*b*).

In this way the individual connecting rod mounting units (consisting in each case of a cover rail section 12*a* and 12*b* and of a connecting rod 31 or 32) can be detachably coupled with the connecting rod gearing 1. For this purpose the connecting rods 31 or 32 are brought into a positive locking engagement with the engagement recesses 22*e* or 23*e* of the thrust links 22 or 23 within the channel 13. Then the cover rail sections 12*a* or 12*b* are inserted between the extension sections 25*c* or 25*d* of the protection cap 25 and the end edges of legs 13*a* and 13*b* of the channel 13 until a throughhole 33*a* or 33*b* which is provided on them comes into alignment with the sinkholes defined by the circular beads 25*e* or 25*f*. Thus, in the assembled position the connecting rod mounting units can be held in operating connection by means of a countersunk screw 34 with the connecting rod gearing 1. This screw 34 also penetrates a throughhole 35 in the bottom 13*c* of the channel forming part of the housing 11. In this way a forced transmitting linkage between the housing 11 of the connecting rod gearing 1 and the structurally separate cover rail sections takes place in these connecting rod mounting units.

Clearly, minor changes may be made in the form and construction of this invention without departing from the material spirit of it. Therefore, it is not desired to confine the invention to the exact form shown here and described, but it is desired to include all subject matter which properly comes within the scope claimed.

I claim:

1. A connecting rod gearing for installation into stepped profile slots of wings or frames of windows or doors, having two oppositely shiftable connecting rods under a flat cover rail defining a cover rail plane, in which each rod is provided with a thrust link equipped with an engagement toothing guided in a housing and held in engagement with each other from opposite sides respectively, by a pinion having toothing and crown circle and root circle diameters, in which the housing is formed by the flat cover rail and by a channel of approximately U-shape situated adjacent to the cover rail, wherein the U-shaped channel has a bottom and mutually bent ends in the form of legs having front faces and inside surfaces, the channel having a smaller width than the width of the cover rail, characterized by the fact that: "the cover rail (12) of the housing (11) has a discontinuity (14) spanning the pinion (15,16) and toothing of the thrust links (22 and 23),"

the pinion with its toothed rim (16) is located in the "spaced defined by the discontinuity" of cover rail (12), the discontinuity is bridged by the U-shaped channel (13) of housing (11) below the plane of the cover rail said crown circle diameter (17) of the pinion toothed rim (16) corresponds to the cover rail width; and the cover rail discontinuity (distance 14) is covered on the outside of cover rail (12) by a protection cap (25).

2. A connecting rod gearing as recited in claim 1 wherein the discontinuity defines two mutually facing end sections of the cover rail which are undergripped by said legs of the mutually bent ends of the U-shaped channel and are connected with them by means of riveting or welding.

3. A connecting rod gearing as recited in claim 1 wherein the protection cap is connected to the bottom of the U-shaped channel and the mutually facing ends of the cover rail sections.

4. A connecting rod gearing as recited in claim 1 wherein the pinion is provided with an engaging dog or lug in alignment with the pinion's axis of rotation, the dog or lug lying freely and aligned with an opening on the protection cap and adapted to be coupled with an operating handle.

5. A connecting rod gearing as recited in claim 1 wherein the pinion is provided with four teeth arranged uniformly in distribution over its circumference.

6. A connecting rod gearing as recited in claim 1 wherein the pinion is provided with a bearing shaft which is within the U-shaped channel and held by means of a recessed neck axially and radially in a bearing bore at the bottom of the U-shaped channel.

7. A connecting rod gearing as recited in claim 1 wherein the thrust links project by means of first and second flanges into the U-shaped channel and are braced against both the front faces and the inside surfaces of the legs of the channel.

8. A connecting rod gearing as recited in claim 7 wherein the thrust links have an angled cross-section and are provided at an inner angle with a stiffening and guiding leg the width of which corresponds to the thickness of the channel legs.

9. Connecting rod gearing as recited in claim 1 wherein the pinion is provided with a bearing shaft and the shaft has an extension which penetrates through an opening in the protection cap.

10. A connecting rod gearing as recited in claim 9 wherein at least one engaging slot extends parallel to the axis of the bearing shaft on the surface of the extension and adapted to be brought into engagement with a corresponding engaging ledge at the inner surface of a clutch hub on an operating handle.

11. A connecting rod gearing as recited in claim 9 wherein the bearing shaft of the pinion contains a profiled channel parallel to the axis of the bearing shaft which has a polygonal cross-section which opens out at a front face of the extension for insertion of a correspondingly profiled engaging lug of an operating handle.

12. A connecting rod gearing as recited in claim 9 wherein the diameter of the extension of the pinion corresponds to said root circle diameter of the pinion toothing.

13. A connecting rod mounting having a gearing as recited in claim 1 wherein the cover rail sections are detachably coupled with the legs of the U-shaped channel and the protection cap.

14. A connecting rod gearing according to claim 13 wherein throughholes are provided in the cover rail sections and in said bottom of the channel through which screws are guided to couple the cover rail sections to engagement with the bottom of the profiled slot.

* * * * *